US011267152B2

(12) United States Patent
Ojeda Viera

(10) Patent No.: US 11,267,152 B2
(45) Date of Patent: Mar. 8, 2022

(54) MANUAL TOOL FOR FOOD CARVING

(71) Applicant: Francisco Jose Ojeda Viera, Carrizal (ES)

(72) Inventor: Francisco Jose Ojeda Viera, Carrizal (ES)

( * ) Notice: Subject to any disclaimer, the term of this patent is extended or adjusted under 35 U.S.C. 154(b) by 395 days.

(21) Appl. No.: 16/347,454

(22) PCT Filed: Oct. 24, 2017

(86) PCT No.: PCT/ES2017/070710
§ 371 (c)(1),
(2) Date: Sep. 23, 2019

(87) PCT Pub. No.: WO2018/083358
PCT Pub. Date: May 11, 2018

(65) Prior Publication Data

US 2020/0031007 A1 Jan. 30, 2020

(30) Foreign Application Priority Data

Nov. 4, 2016 (ES) ..... ES201631312U

(51) Int. Cl.
*B26D 3/26* (2006.01)
*B26B 29/02* (2006.01)

(52) U.S. Cl.
CPC ..... *B26D 3/26* (2013.01); *B26B 29/02* (2013.01)

(58) Field of Classification Search
CPC ..... B26D 3/26; B26B 29/02
See application file for complete search history.

(56) References Cited

U.S. PATENT DOCUMENTS 1,390,720 A * 9/1921 Powers ..... B26B 29/025 606/167
3,608,195 A * 9/1971 Levin ..... B26B 29/02 30/162
2008/0110033 A1* 5/2008 Peterson ..... B26B 29/025 30/329

FOREIGN PATENT DOCUMENTS

GB 558026 A 12/1943
GB 1597108 A 9/1981
RU 2270750 C1 2/2006

* cited by examiner

*Primary Examiner* — Omar Flores Sanchez
(74) *Attorney, Agent, or Firm* — Blue Filament Law PLLC

(57) ABSTRACT

A manual tool includes a support (1) with stops (20) on which the carving elements (2) are arranged and includes a first central tubular sector (7) having a hollow interior; second lateral sectors (10); wings (11) facing each other that start from each of the second sectors (10); a recess (12) between both wings (11), for housing the carving element (2); and a rotating part (16) mounted between the wings (11), that includes two couplings (15) and two housings (17) and (18), in which the rotating part (16) is rotatory between a first position in which the carving element (2) linked to the first housing (17) while the carving element (2) linked to the second housing (18) is oriented inwards the recess (12) and a second position in which the carving element (2) of the first housing (17) is oriented inward toward the recess (12).

18 Claims, 2 Drawing Sheets

MANUAL TOOL FOR FOOD CARVING

OBJECT OF THE INVENTION

This invention is within the technical field of the devices for the treatments of fruits, as well as that of the kitchen manual instruments and refers namely to a manual tool for carving foods, preferably fruits and vegetables, with decorative purposes.

BACKGROUND OF THE INVENTION

Sculpting or carving foods, mainly vegetal foods such as fruits and vegetables, is an oriental technique that receives the name of Mukimono, and by means of which the said fruits and vegetables take given shapes, mainly of flowers, but also of leaves, landscapes, animals and even ideogram messages. The application done of the carving is mainly artistic, to decorate areas where meals are served, as well as centerpieces in celebrations and similar events, for which figures use to be carved with motifs alluding to the said event. However, the objective of this technique is not only to highlight the shapes and colors, but also to emphasize the scents and tastes.

Among the most used vegetables are carrots, turnips, radishes, cucumbers, eggplants, onions, peppers or pumpkins. On the other hand, the fruits most usually used for carving are melon, kiwis, apples, pineapples, oranges and lemons. Most of the makings require immersing the food in water with ice, because the cold water allows that the sections and cuts open, getting apart, spiral- or curve-shaped, without losing their stiffness.

The carving is carried out with scarcely thick, sharp and high-precision tools. The main tools used for carving vegetal products are knifes, either paring knifes or "torneador" knifes, the gouges, the corers, the peelers, and the curlers.

DESCRIPTION OF THE INVENTION

The object of the invention consists of a hand-operated tool for carving foods, preferably fruits and vegetables, freehand, that allows coupling, for their use, a plurality of cutting and carving utensils, preferably four, on a sole base, which facilitates the work as several parts are available at the same time, without changing them is required, thus saving work time and space.

For this, the tool comprises a support, of a preferably tubular geometry, at which ends the selected cutting and carving utensils are temporarily linked. In a preferred embodiment, at each of the said ends, a rotating part is mounted in the body of which two housings are defined, opposite to each other, to each of which the shank of a carving utensil is temporarily coupled. The rotating part rotates about a longitudinal axis so that, depending on the work requirements, one or the other utensil remains in working position, and thus in a single tool it is possible to have available up to four carving tools, which can be exchanged or replaced.

The support, in addition, incorporates a sheath-type part cover, that facilitates seizing and fastening it during its use, as well as it protects the user from possible cuts and abrasions due to the cutting and sharp nature that the utensils usually have.

The manual tool thus disclosed achieves a simultaneous simplification of the work operations for fruits and vegetables decorative cutting and carving, the guaranty of a simple and safe use of cutting and carving appliances, the reduction of the body strength that is necessary to be applied during the carving process, and the increase of such carving speed and quality.

DESCRIPTION OF THE DRAWINGS

To complement the description that is being carried out and in order to assist to best understanding the characteristics of the invention, according to a preferred example of practical embodiment thereof, a set of drawings is attached as an integral part of the said description, in which for illustration and non-limitation purpose the following has been represented.

PREFERRED EMBODIMENT OF THE INVENTION

Thereafter, with the assistance of the above referred figures, a detailed explanation of an example of preferred embodiment of the object of this invention is provided.

Figure 1:
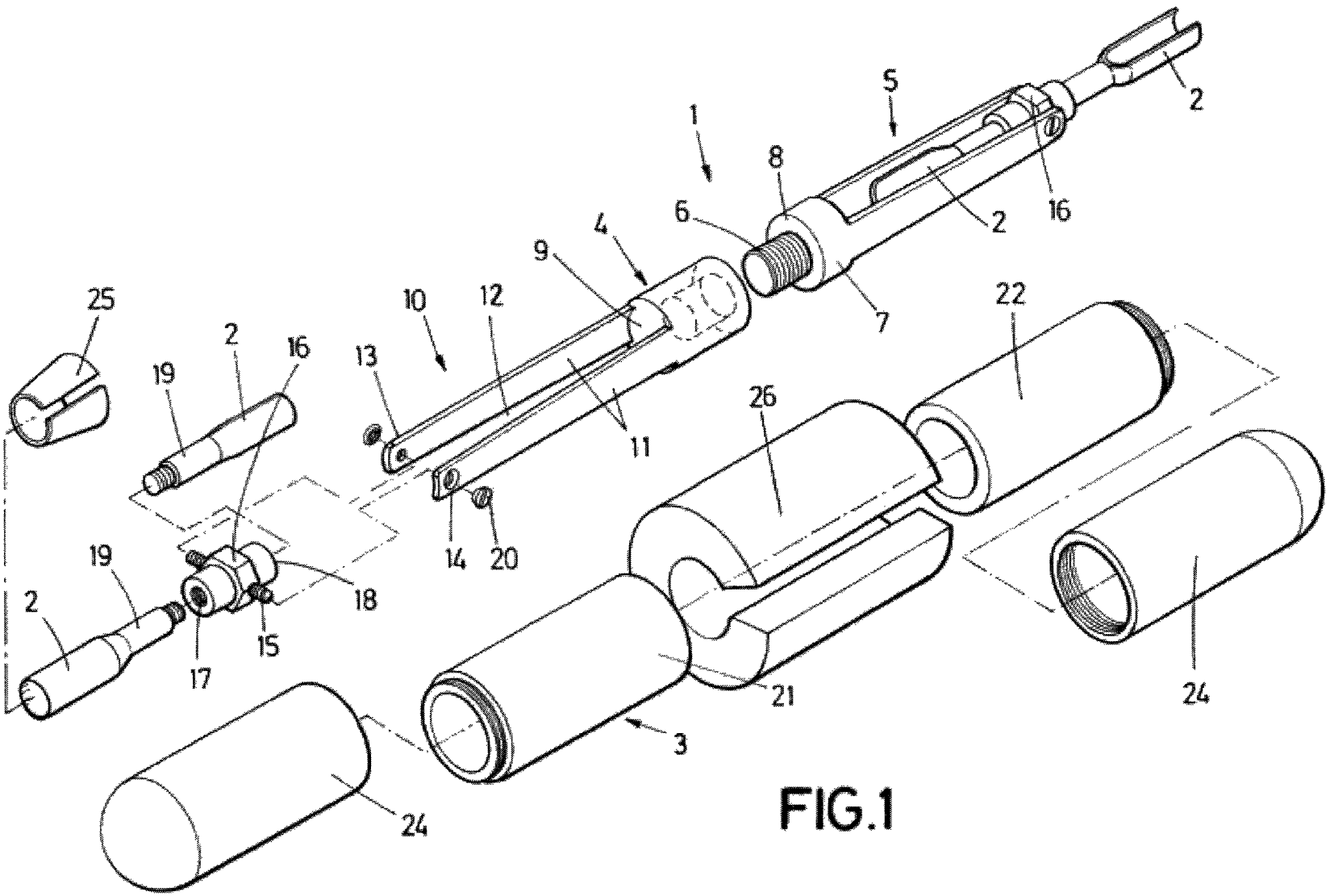
FIG. 1.—It shows an exploded plan view of the tool, in which its main constitutive elements can be seen.

The manual tool for carving foods that is disclosed, shown in the FIG. 1, is formed by a support (1) to which a plurality of carving elements (2) is temporarily linked, of those usually used for carving foods, and a sheath (3) that externally covers the assembly formed by the support (1) with the carving elements (2), allowing to seize and carry it.

As it can be seen in the said FIG. 1, the support (1) comprises in turn a first body (4) and a second body (5) linked to each other by means of respective threads (6). Each of the bodies (4,5) of the support (1) comprises a first sector (7) having an essentially tubular geometry and a hollow interior, with a first end (8) on which the thread (6) is defined and a second end (9) from which the second sector (10) starts.

The second sector (10) of each of the first (4) and second body (5) comprises two wings (11) facing each other, having an essentially parallelepiped and plane geometry, protruding from the second end (9), as well as a recess (12) defined in the gap comprised between both wings (11).

Each of the said wings (11) comprises a distal end (13), opposite to that from which a wing (11) protrudes, in which a hole (14) is defined. In each hole (14) of each of the wings (11), respective couplings (15) of a rotating part (16) are housed. This rotating part (16) comprises in turn a body, in which a first housing (17) and a second housing (18) are defined, located opposite to the first housing (17), each of the said housings (17,18) being designed to house a shank (19) of a carving element (2).

The rotating part (16) rotates about an axis defined between its transverse couplings (15), so that, in a first position, the carving element (2) linked to the first housing (17) is oriented outwards the distal end (13), in working disposition, while the carving element (2) linked to the second housing (18) is oriented inwards the recess (12) defined between the wings (11).

For best safety during the work, and given the cutting and sharp condition of the carving elements (2), it is also contemplated to additionally incorporate some stops (20) that prevent that the rotating part (16) moves, with the carving elements (2) linked to it, when the working position sought is reached.

Figure 2:
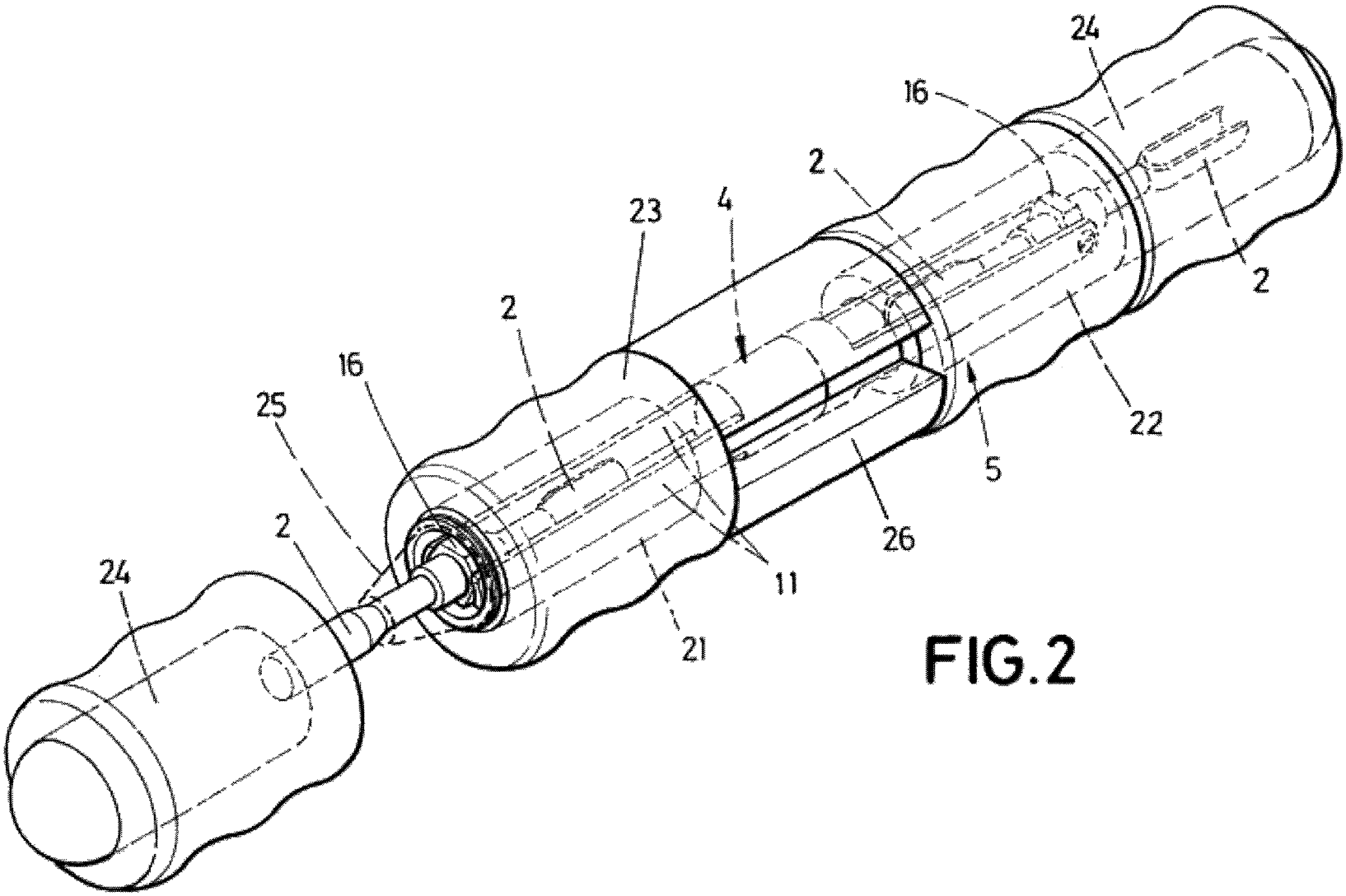
FIG. 2.—It shows a plan view of the mounted tool, in which 5 of its elements contained within the sheath are left partly visible.

The sheath (3), of an essentially tubular geometry and hollow interior, is composed in turn of a first portion (21) and a second portion (22) linked to each other, in correspondence with the respective first body (4) and second body (5) of the support (1), that it partly covers, as it appears in the FIG. 2, to allow the use of the carving elements (2) linked to the support (1) contained within it, which emerge from the free ends of the said sheath (3).

In the preferred embodiment herein shown, the first portion (21) and the second portion (22) are joined to each other by screwing, and the sheath (3) comprises in addition a cover (23) to facilitate its handling.

Some plugs (24) are pressure linked to the free ends of the sheath (3), to cover the carving elements (2) linked to the support (1) contained within it. The said plugs (24) can also be covered by the cover (23) to facilitate their handling and provide the tool with a more compact appearance when it is closed.

In addition, fastening elements (25) are linked to each of the respective free ends of the sheath (3) to keep the rotating part (16) in a fixed position, increasing thus the safety of the tool. For this, as it is shown in the figures attached, each of the fastening elements (25) comprises a truncated-cone-shaped body having a hollow interior with a longitudinal through grooving defined on its surface, through which the shank (19) of the carving element (2) passes, which remains immobilized within the said fastening element (25) and cannot be laterally moved.

Additionally, the interposition of a central portion (26) is envisaged, extractable between the first portion (21) and the second portion (22) of the sheath (3). The said central portion (26) comprises a longitudinal grooving defined on its surface, as it can be seen in the FIG. 1, and allows that, it is withdrawn, a longitudinal move can occur as well of the first portion (21) as of the second portion (22), leaving thus a free surface that allows the rotation of the rotating part (16).

When used, the manual tool for carving foods thus disclosed allows to have up to four carving elements (2) simultaneously ready for their use on a sole support (1), which means a significant time and space saving during the operations of forming decorative compositions.

The invention claimed is:

1. A manual tool for carving foods, designed to temporarily and simultaneously house a plurality of carving elements (2) provided with a coupling shank (19), to allows its use, the manual tool comprises a support (1) on which the carving elements (2) are arranged, the support (1) that comprises in turn:

- a first central sector (7) having an essentially tubular geometry and a hollow interior,
- second lateral sectors (10), defined on both sides of the first sector (7),
- wings (11) starting from each of the second sectors (10), the said wings (11) being opposite to each other,
- a recess (12) defined in the gap comprised between both wings (11), for housing a carving element (2), and
- a rotating part (16) mounted between the wings (11), that comprises a first housing (17) and a second housing (18), opposite to the first housing (17), each of the said housings (17,18) being designed to house the shank (19) of the carving element (2), in which the rotating part (16) is rotatory between a first position in which the carving element (2) linked to the first housing (17) is oriented outwards the support (1) while the carving element (2) linked to the second housing (18) is oriented inwards the recess (12) defined between the wings (11), and a second position in which the carving element (2) linked to the first housing (17) is oriented inwards the recess (12) and the carving element (2) of the second housing (19) is oriented outwards and the support (1) incorporates stops (20) to prevent that the rotating part (16) are moved.

2. The manual tool for carving foods according to the claim 1 further comprising a sheath (3), having an essentially tubular geometry and hollow interior, that surrounds and partly contains the support (1) to allow the use of the carving elements (2) linked to the support (1) contained within it, which emerge from the free ends of the said sheath (3).

3. The manual tool for carving foods according to the claim 1 wherein the support (1) further comprises in turn a first body (4) and a second body (5), linked to each other by threads (6).

4. The manual tool for carving foods according to claim 2 wherein the sheath (3) further comprises a first portion (21) and a second portion (22) linked to each other, in correspondence with the respective first body (4) and second body (5) of the support (1).

5. The manual tool for carving foods according to the claim 1 wherein the rotating part (16) further comprises couplings (15) to be linked to holes (14) defined in the wings (11).

6. The manual tool for carving foods according to claim 2 wherein the sheath (3) further comprises a cover (23).

7. The manual tool for carving foods according to claim 2 wherein the sheath (3) further comprises plugs (24) to cover the carving elements (2) linked to the support (1).

8. The manual tool for carving foods according to claim 1 further comprising fastening elements (25) each having a truncated coned-shaped body.

9. The manual tool for carving foods according to the claim 8 wherein the fastening elements (25) each further comprise a longitudinal through grooving.

10. The manual tool for carving foods according to claim 2 further comprising a central portion (26) extractable between a first portion (21) and a second portion (22) of the sheath (3).

11. The manual tool for carving foods according to the claim 10 wherein the central portion (26) further comprises a longitudinal through grooving.

12. The manual tool for carving foods according to claim 3 further comprising a sheath (3) that further comprises a first portion (21) and a second portion (22) linked to each other, in correspondence with the respective first body (4) and second body (5) of the support (1).

13. The manual tool for carving foods according to claim 4 wherein the sheath (3) further comprises a cover (23).

14. The manual tool for carving foods according to claim 4 wherein the sheath (3) further comprises plugs (24) to cover the carving elements (2) linked to the support (1).

15. The manual tool for carving foods according to claim 6 wherein the sheath (3) further comprises plugs (24) to cover the carving elements (2) linked to the support (1).

16. The manual tool for carving foods according to claim 4 further comprising a central portion (26) extractable between the first portion (21) and the second portion (22) of the sheath (3).

17. The manual tool for carving foods according to claim 6 further comprising a central portion (26) extractable between a first portion (21) and a second portion (22) of the sheath (3).

18. The manual tool for carving foods according to claim 7 further comprising a central portion (26) extractable between a first portion (21) and a second portion (22) of the sheath (3).

* * * * *